United States Patent [19]

Dolansky et al.

[11] Patent Number: 4,647,121

[45] Date of Patent: Mar. 3, 1987

[54] DISTRIBUTOR STRIP COMPRISING A PLURALITY OF DOUBLE TERMINAL POSTS ALLOWING NON-STRIPPED CONNECTION OF ELECTRICAL CONDUCTORS

[75] Inventors: Franz Dolansky, Munich; Ewald Steiner, Berg, both of Fed. Rep. of Germany

[73] Assignee: Siemens Aktiengesellschaft, Berlin & Munich, Fed. Rep. of Germany

[21] Appl. No.: 719,331

[22] Filed: Apr. 3, 1985

[30] Foreign Application Priority Data

Apr. 3, 1984 [DE] Fed. Rep. of Germany ..... 3412468

[51] Int. Cl.[4] ..... H01R 4/66

[52] U.S. Cl. ..... 339/14 R; 339/198 N; 361/119

[58] Field of Search ..... 339/14 R, 147 R, 198 N; 361/119

[56] References Cited

U.S. PATENT DOCUMENTS 4,159,500 6/1979 Baumbach et al. ..... 361/119

4,345,294 8/1982 Forberg et al. ..... 361/119

*Primary Examiner*—Eugene F. Desmond

*Attorney, Agent, or Firm*—Hill, Van Santen, Steadman & Simpson

[57] ABSTRACT

A distributor strip has a plurality of chambers with each chamber having a pair of terminal posts for non-strip connection to electrical conductors. A portion of the grounding rail is provided in each chamber and an over-voltage arrestor may be mounted in each chamber between a contact spring connecting to each terminal post and the grounding rail portion. The contact springs include a bent free leg with a length chosen such that when the over-voltage arrestor together with an associated solder ring is inserted, a leading end of the free leg does not contact the grounding rail, but when the solder ring melts, the leading end comes into contact with the grounding rail.

4 Claims, 4 Drawing Figures

DISTRIBUTOR STRIP COMPRISING A PLURALITY OF DOUBLE TERMINAL POSTS ALLOWING NON-STRIPPED CONNECTION OF ELECTRICAL CONDUCTORS

RELATED APPLICATION

Attention is drawn to related applications, Ser. Nos. 719,30 and 719,342 copending herewith, and by the same inventors of the instant application.

BACKGROUND OF THE INVENTION

The invention relates to a distributor strip comprising a plurality of double terminal posts allowing the non-stripped connection of electrical conductors. The double terminal posts are held in sockets at the upper long sides of an insulating member having an approximately square cross-section. A plurality of upwardly open receptacle chambers are provided for surge arrestors. These chambers are separated by partitions and are provided in the upper part of the insulating member along a longitudinal direction of said insulating member. Contact springs connected to the terminal posts are provided at those side walls of the receptacle chambers proximate to the terminal posts. Parts of a grounding rail project into the receptacle chambers between two respective contact springs lying opposite one another.

Such a distributor strip can be employed exclusively as a terminal strip but it can also be subsequently arbitrarily equipped with surge arrestors. The disadvantage of this distributor strip is that the individual leads of the connecting lines can only be protected against overvoltages but not against overcurrents.

SUMMARY OF THE INVENTION

An object of the present invention is to specify a distributor strip of the type initially cited wherein it is possible to protect the individual leads against both overvoltages as well as overcurrents.

For a distributor strip of the type initially described, this object is achieved in that those parts of the contact springs projecting into the receptacle chambers are designed in right-angled fashion such that the free lag is resectively situated proximate to the floor, and wherein its outer edge is pressed against the grounding rail. A length of the free legs is dimensioned such that, after the insertion of an overvoltage arrestor and of a solder ring, the distance between its outer edge and the grounding rail is less than a thickness of the solder ring.

In the distributor strip of the invention, the outer edge of the contact spring respectively forms a grounding contact which connects the corresponding lead to ground potential after the solder ring has melted due to overcurrent. A protection against overcurrents is thus provided in a simple fashion, merely by modification of the contact springs lying in the receptacle chambers and by the additional insertion of a solder ring.

DESCRIPTION OF THE PREFERRED EMBODIMENTS

Figure 1:
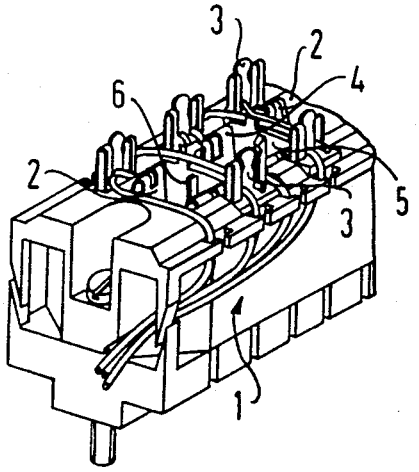
FIG. 1 is a perspective, partial view of a distributor strip of the invention.

The distributor strip 1 shown partially iin perspective in FIG. 1 comprises receptacle chamber 2 at its upper part for the acceptance of overvoltage arrestors. Situated at the upper longitudinal sides of the distributor strip 1 in receptacles are a plurality of double terminal posts 3 which are connected to contact springs 4 which includes an inverted U-shaped portion projecting in at the neighboring side walls of the receptacle chambers 2. Parts of a grounding rail project into the receptacle chamber 2 between the contact springs 4. The individual receptable chambers are separated from one another by partitions 5.

Figure 2:
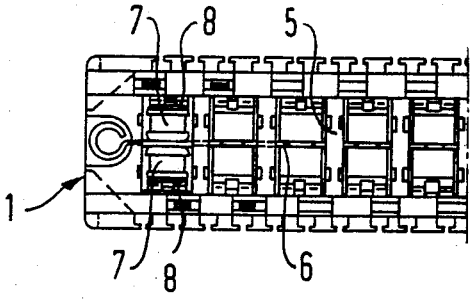
FIG. 2 is a partial plan view of the distributor strip of the invention.
Figure 3:
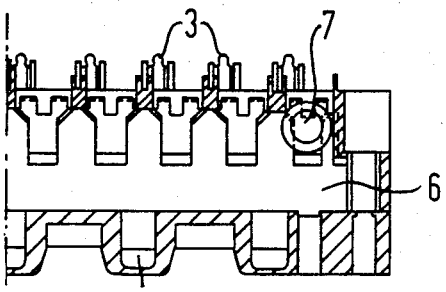
FIG. 3 is a view of a partial section through the distributor strip of the invention.

The equipping of the receptacle chambers with overvoltage arrestors 7 and solder rings 8 may be derived from FIG. 2. The arrangement of the grounding rail 6 in the distributor strip 1 can be derived from FIG. 3.

Figure 4:
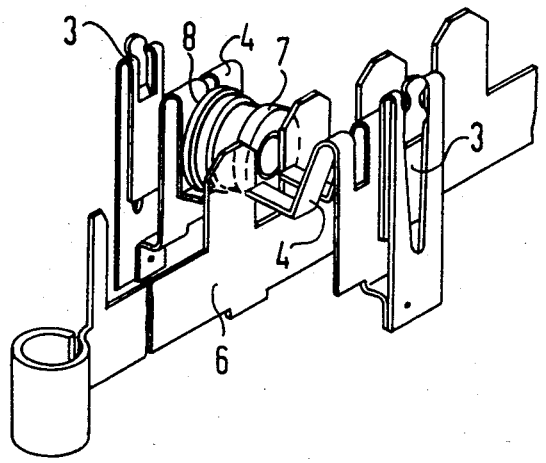
FIG. 4 is a perspective view of the grounding rail and of the contact springs with the corresponding terminal posts.

The fashioning of the parts of the contact springs 4 projecting into the receptacle chambers can be derived from FIG. 4. As may be determined from this figure, the outer edge of the downwardly disposed, free leg of the contact spring 4 presses against the grounding rail 6 when the receptacle chamber is not equipped and forms a ground contact with this grounding rail 6. By inserting an overvoltage arrestor 7 and a solder ring 8, the outer edge of the free leg is forced away from the grounding rail 6 to such degree that a grounded contact no longer exits. This grounded contact is not reestablished until there is an overcurrent, when the solder ring 8 is melted. The distance between the outer edge of the contact spring 4 and the grounding rail 6 is therefore selected such that, given an inserted overvoltage arrestor 7 and solder ring 8, it is smaller than the thickness of the solder ring 8. After the solder ring has melted off, a reliable grounded contact between the contact spring 4 and the grounding rail 6 is guaranteed in this fashion. Although various minor changes and modifications might be proposed by those skilled in the art, it will be understood that we wish to include within the claims of the patent warranted hereon all such changes and modifications as reasonably come within our contribution to the art.

We claim as our invention:

1. A distributor strip, comprising:

a plurality of terminal post means for non-stripped connection of electrical conductors;

said terminal post means being held in socket portions at upper longitudinal sides of an insulating member;

a plurality of upwardly open receptacle chamber means for accommodating surge arrestors in said insulating member;

said chamber means being separated by partitions in an upper part of the insulating member and arranged side by side along the insulating member;

contact springs connected to the terminal post means at side walls of the receptacle chamber means proximate to the connected terminal post means;

portions of a grounding rail projecting into the plurality of receptacle chamber means and between the contact springs lying at opposite sides of the grounding rail;

an integral portion of each contact spring projecting into the receptacle chamber means formed by an approximate right-angle bend relative to an integral inverted U-shaped portion such that a free leg is formed situated proximate to a floor of the chamber means and lying beneath the arrestor when the arrestor is inserted, a leading edge of the free leg contacting the grounding rail when surge arrestors are not present in the respective receptacle chamber means, and the U-shaped portion being positioned such that one side of the U-shaped portion is biased by an inserted overvoltage arrestor; and a length of the free leg being dimensioned such that after insertion of an overvoltage arrestor with an associated solder ring between the grounding rail and a corresponding contact spring, a distance between said leading edge and the grounding rail being less than a thickness of the solder ring.

2. A distributor strip, comprising:

a plurality of terminal post means for making insulation stripping connection to electrical conductors;

an insulating member having a plurality of overvoltage arrestor receiving locations therein with each location having two of said terminal post means, one adjacent each opposite side thereof;

a ground rail having a portion extending into each location between the two terminal post means;

for each location, each terminal post means having a contact spring attached thereto and positioned at the location at each side of the ground rail portion, the contact spring and ground rail portion being spaced so that in each location a surge voltage arrestor with an associated solder part can be received and contacted between the respective contact spring and grounding rail portion;

each contact spring comprising an integral inverted U-shaped portion positioned such that one side of the U-shaped portion is biased by an inserted overvoltage arrestor, and a free leg bent at an angle relative to remaining portions of the contact spring which lies beneath the arrestor when the arrestor is inserted and having a length chosen such that when a corresponding overvoltage arrestor is mounted at the location between the portion of the ground rail and the associated contact spring, the overvoltage arrestor together with its solder part spaces a leading edge of the free leg away from the portion of the grounding rail, and when the solder part melts, the leading end of the free leg contacts the grounding rail.

3. A distributor strip according to claim 2 wherein the ground rail is formed in comblike fashion with teeth extending from a main rear portion into a chamber formed at each location.

4. A distributor strip, comprising:

a plurality of terminal post means for making insulation stripping connection to electrical conductors;

an insulating member having a plurality of chambers therein with each chamber having two of said terminal post means, one adjacent each opposite side thereof;

a ground rail having a portion extending into each chamber between the two terminal post means;

for each chamber, each terminal post means having a contact spring attached thereto and positioned in the chamber at each side of the ground rail portion, the contact spring and ground rail portion being spaced so that in each chamber a surge voltage arrestor with an associated solder part can be received and contacted between the respective contact spring and grounding rail portion;

each contact spring comprising a free leg bent at an angle relative to remaining portions of the contact spring and having a lenth chosen such that when a corresponding overvoltage arrestor is mounted in the chamber between the portion of the ground rail and the associated contact spring, the overvoltage arrestor together with its solder part spaces a leading edge of the free leg away from the portion of the grounding rail, and when the solder part melts, the leading end of the free leg contacts the grounding rail; and the terminal post means and connected contact spring comprising said free leg bent at approximately right angles relative to an integral inverted U-shaped portion with a first slot therein, and said inverted U-shaped portion connecting to a further terminal portion having a second slot therein spaced from the first slot.

* * * * *